US007954466B2

(12) United States Patent
Nguyen et al.

(10) Patent No.: US 7,954,466 B2
(45) Date of Patent: Jun. 7, 2011

(54) PROCESS FOR ADJUSTING THE ANGULAR POSITION OF THE CAMSHAFT OF A RECIPROCATING INTERNAL COMBUSTION ENGINE RELATIVE TO THE CRANKSHAFT

(75) Inventors: Minh Nam Nguyen, Buehl (DE); Heiko Dell, Buehlertal (DE); Holger Stork, Buehl (DE)

(73) Assignee: Schaeffler KG, Herzogenaurach (DE)

( * ) Notice: Subject to any disclaimer, the term of this patent is extended or adjusted under 35 U.S.C. 154(b) by 393 days.

(21) Appl. No.: 11/719,366

(22) PCT Filed: Oct. 25, 2005

(86) PCT No.: PCT/DE2005/001903

§ 371 (c)(1),
(2), (4) Date: Mar. 10, 2009

(87) PCT Pub. No.: WO2006/053513

PCT Pub. Date: May 26, 2006

(65) Prior Publication Data

US 2009/0183701 A1 Jul. 23, 2009

(30) Foreign Application Priority Data

Nov. 16, 2004 (DE) ..... 10 2004 055 164

(51) Int. Cl.
*F01L 1/34* (2006.01)

(52) U.S. Cl. ..... 123/90.17; 123/90.15; 123/406.58; 464/160; 701/105

(58) Field of Classification Search ..... 123/90.15, 123/90.16, 90.17, 90.18, 90.27, 90.31, 406.58, 123/406.59, 406.63, 406.64; 464/1, 2, 160; 701/101, 102, 105, 110
See application file for complete search history.

(56) References Cited

U.S. PATENT DOCUMENTS

| | | | |
|---|---|---|---|
| 4,481,912 A | 11/1984 | Stwiorok et al. | |
| 7,721,693 B2 * | 5/2010 | Nguyen et al. | 123/90.17 |

FOREIGN PATENT DOCUMENTS

| | | |
|---|---|---|
| DE | 100 38 354 A | 2/2002 |
| DE | 102 20 687 A | 11/2003 |
| DE | 102 36 507 A | 2/2004 |
| EP | 1 375 832 A | 1/2004 |
| EP | 1 607 589 E | 12/2005 |
| WO | 2004/007917 A | 1/2004 |
| WO | 2005/012698 PX | 2/2005 |

* cited by examiner

*Primary Examiner* — Ching Chang
(74) *Attorney, Agent, or Firm* — Lucas & Mercanti, LLP

(57) ABSTRACT

In a method for setting the rotary angle position of the camshaft of a reciprocating piston internal combustion engine relative to the crankshaft, the crankshaft is connected to the camshaft by means of a triple-shaft gear mechanism. This triple-shaft gear mechanism has a drive shaft which is fixed to the crankshaft, an output shaft which is fixed to the camshaft, and an adjusting shaft which is driven by an electric motor.

7 Claims, 3 Drawing Sheets

Figure 1:
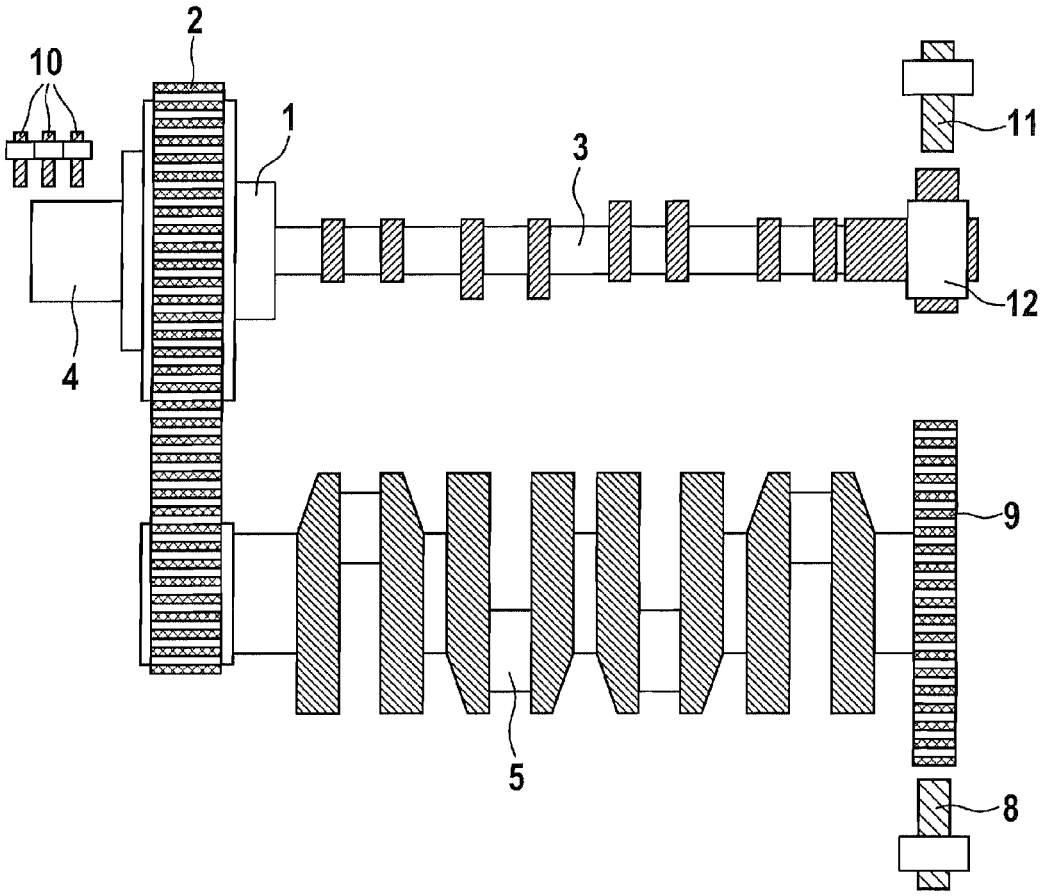

PROCESS FOR ADJUSTING THE ANGULAR POSITION OF THE CAMSHAFT OF A RECIPROCATING INTERNAL COMBUSTION ENGINE RELATIVE TO THE CRANKSHAFT

The invention relates to a method for setting the rotary angle position of the camshaft of a reciprocating piston internal combustion engine relative to the crankshaft, wherein the crankshaft is drive-connected to the camshaft by means of an adjusting gear mechanism which is in the form of a triple-shaft gear mechanism with a drive shaft which is fixed to the crankshaft, an output shaft which is fixed to the camshaft, and an adjusting shaft which is drive-connected to an electric motor, wherein the crankshaft rotates and a crankshaft sensor signal is detected which changes its state when the rotary angle of the crankshaft changes, wherein the adjusting shaft rotates and an adjusting shaft sensor signal is detected which changes its state when the rotary position of the adjusting shaft changes, wherein a phase angle signal is updated, on the basis of a reference rotary angle value which is associated with a reference rotary angle position, when the state of the crankshaft sensor signal and/or of the adjusting shaft sensor signal changes, wherein the phase angle signal is adjusted to a provided setpoint phase angle signal, and wherein the ignition of the internal combustion engine is switched off and/or the rotational speed of the crankshaft is lowered to below a prespecified minimum rotational speed value.

Such a method is known from DE 41 10 195 A1. In the said method, the rotary angle position of the camshaft relative to the crankshaft is adjusted using an electric motor which drives an adjusting shaft of a triple-shaft gear mechanism which is arranged between the crankshaft and the camshaft. A camshaft gearwheel, which is driven, via a chain, by a crankshaft gearwheel which is connected to the crankshaft in a rotationally fixed manner, is provided on the drive shaft of the triple-shaft gear mechanism. The output shaft of the triple-shaft gear mechanism is connected in a rotationally fixed manner to the camshaft. In order to adjust the rotary position or phase angle of the camshaft relative to the crankshaft to a provided setpoint phase angle signal, the phase angle is measured and compared with the setpoint value signal. When a deviation occurs, the electric motor is actuated in such a way that the deviation is reduced. In order for the motor function to be maintained even in the event of a fault in the adjusting apparatus, the relative adjustment is limited to a maximum adjustment angle with the aid of a stop element which is connected to the drive shaft and interacts with a mating stop element which is fixed to the camshaft. In comparison to a corresponding reciprocating piston internal combustion engine which is operated with a constant phase angle, this provides better cylinder filling, as a result of which fuel can be saved, pollutant emissions can be reduced and/or the output power of the internal combustion engine can be increased. However, this applies to the starting operation of the internal combustion engine only to a limited extent since no measured values for the phase angle of the camshaft are yet available during part of the starting operation, and it is therefore not possible to optimally set the phase angle.

The object is therefore to provide a method of the type mentioned in the introduction which facilitates low pollutant emissions and low fuel consumption during the starting operation of the internal combustion engine.

In a method of the type mentioned in the introduction, this object is achieved in that, when the ignition is switched off and/or after the rotational speed of the crankshaft falls below the minimum rotational speed value of the crankshaft, the electric motor is supplied with power—while the crankshaft and/or the camshaft are/is still rotating—in such a way that the camshaft rotates in the direction of a prespecified reference position relative to the crankshaft.

When the internal combustion engine is next started, the camshaft is then advantageously already arranged at or in the vicinity of the reference position relative to the crankshaft at the beginning of the starting operation. As a result, the camshaft can be positioned at the reference position at an early stage when the internal combustion engine is started in order to detect this reference position with the aid of the sensor. The phase angle signal can then be set to a reference value which is associated with the reference position at the said reference position and then adjusted to the provided setpoint phase angle signal. The rotary angle position can therefore already be set relatively accurately to the setpoint phase angle signal shortly after the internal combustion engine is started, and this facilitates low pollutant emissions and low fuel consumption of the internal combustion engine during the starting operation.

In one advantageous embodiment of the invention, the power supply to the electric motor is changed to a retaining power supply in order to maintain the reference position when the reference position is detected when the ignition is switched off and/or after the rotational speed falls below the minimum rotational speed value. If the reference position should already be set before the camshaft and/or the crankshaft of the internal combustion engine come to a stop, the retaining power supply ensures that the phase angle does not depart from the reference position on account of the parts of the internal combustion engine which are still moving.

The retaining power supply is expediently terminated when the crankshaft and the camshaft come to a stop or the crankshaft reaches the minimum rotational speed value again. Once the crankshaft of the internal combustion engine has reached the rotational speed zero, the retaining power supply is thus immediately switched off in order firstly to protect the electric motor against overloads and secondly to conserve the battery of the internal combustion engine. If the crankshaft again reaches the minimum rotational speed value once the crankshaft rotational speed has already been lowered to below the minimum rotational speed value by applying a corresponding braking torque to the crankshaft, the retaining power supply is likewise terminated in order to again adjust the phase angle to the setpoint phase angle signal.

In one preferred refinement of the invention, a stop element is connected to the drive shaft and a mating stop element is connected to the camshaft, wherein the stop element comes to rest against the mating stop element at the reference position, and wherein the rate of change in the phase angle signal is measured and the fact that the reference position is reached is detected on the basis of an absolute reduction in the rate of change. Whereas, in the event of travel up to a stop, the stop element and the mating stop element are moved towards one another with the aid of the electric motor in order to position the camshaft at the reference position, the rate of change in the phase angle signal is preferably adjusted to a prespecified value. When the reference position is reached, the rate of change reduces in spite of this speed control, and this permits the reference position to be detected in a simple manner.

It is advantageous if, during retaining power supply, a torque is applied to the adjusting shaft with the aid of the electric motor, which torque positions the stop element against the mating stop element. The stop element is then prestressed against the mating stop element, and this allows the camshaft and the crankshaft to be exactly positioned at the reference position. The retaining power supply is preferably carried out at a prespecified current intensity.

It is particularly advantageous if the phase angle signal continues to be adjusted after the ignition is switched off and/or after the rotational speed falls below the minimum rotational speed value for as long as the control device generates the setpoint phase angle signal and the rotational speed of the crankshaft exceeds a prespecified limit value, and if the camshaft is then rotated in the direction of the reference position relative to the crankshaft with the aid of the electric motor. By virtue of this measure, it is also possible to achieve low pollutant emissions and low fuel consumption when stopping the internal combustion engine.

In one expedient refinement of the invention, a reference marker is generated in the crankshaft sensor signal when a prespecified reference rotary angle position of the crankshaft is reached before the ignition is switched off and/or before the rotational speed of the crankshaft is lowered to below the minimum rotational speed value, wherein a rotary angle measurement signal is set to a value which is associated with the reference rotary angle position when the reference marker occurs, wherein the rotary angle measurement signal is updated when the crankshaft sensor signal changes state, wherein a position measurement signal is set to a position measurement signal start value, wherein the position measurement signal is updated each time the adjusting shaft sensor signal changes state, wherein a camshaft reference signal is generated when a prespecified rotary angle position of the camshaft is reached, wherein the measurement values, which are respectively present when the camshaft reference signal occurs, of the rotary angle measurement signal and of the position measurement signal are determined and these measurement values and the gear mechanism characteristic variable are used to determine a value for the phase angle signal. As a result, the absolute phase angle of the camshaft relative to the crankshaft can be measured with a high degree of precision.

Figure 2:
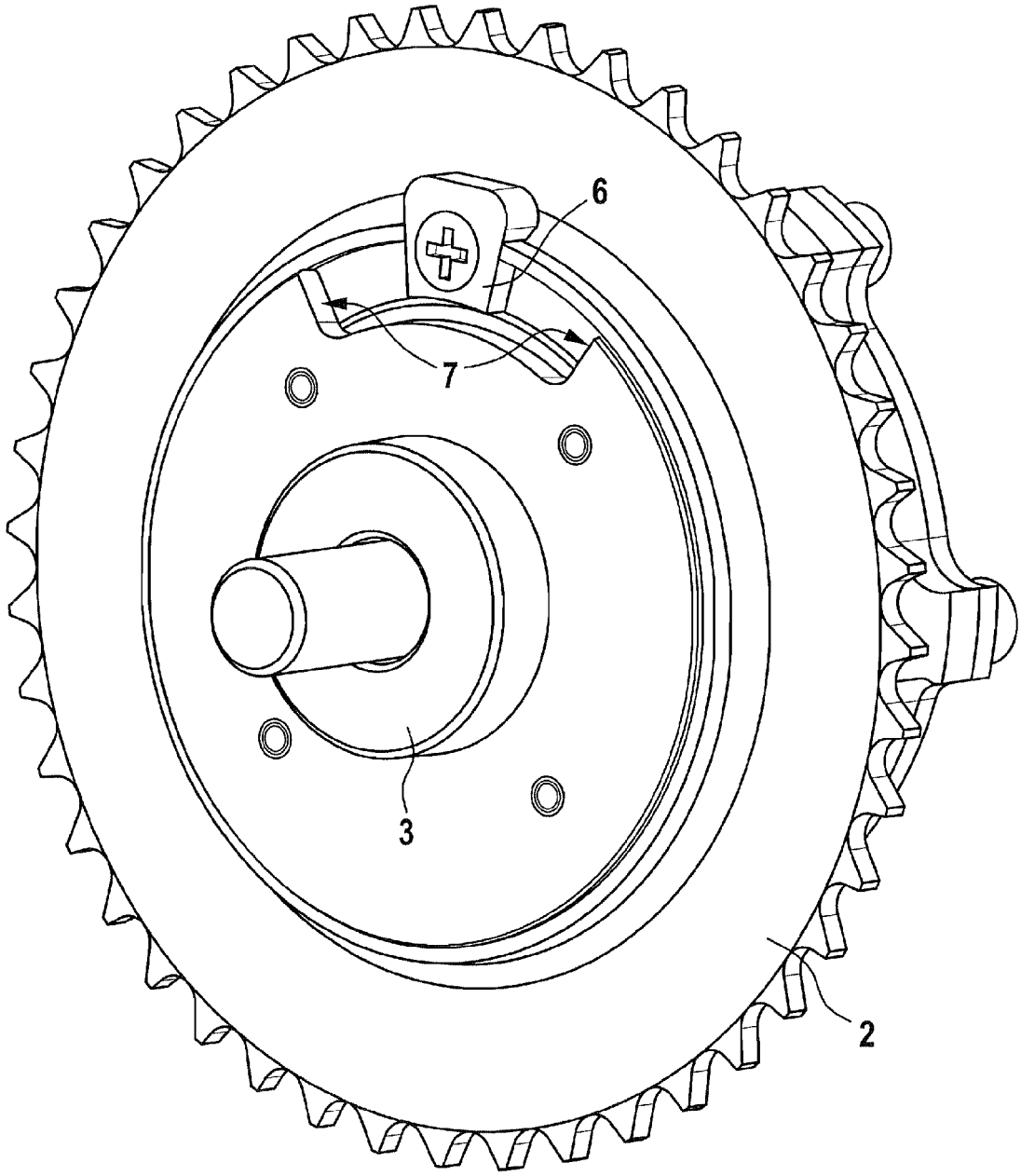
Figure 3:
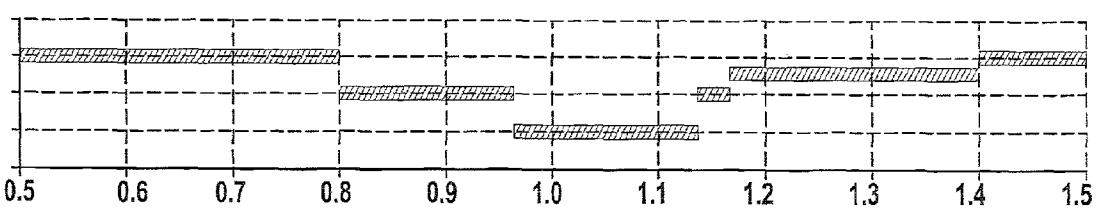
Figure 4:
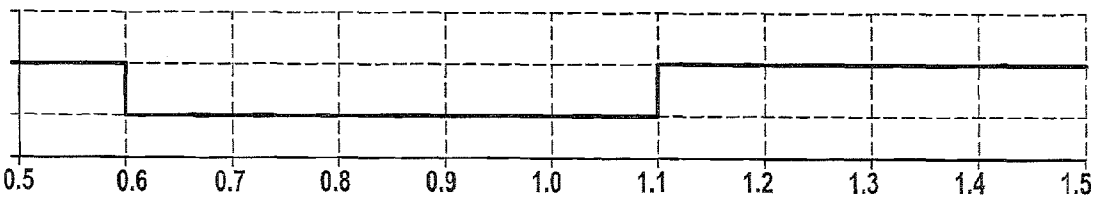
Figure 5:
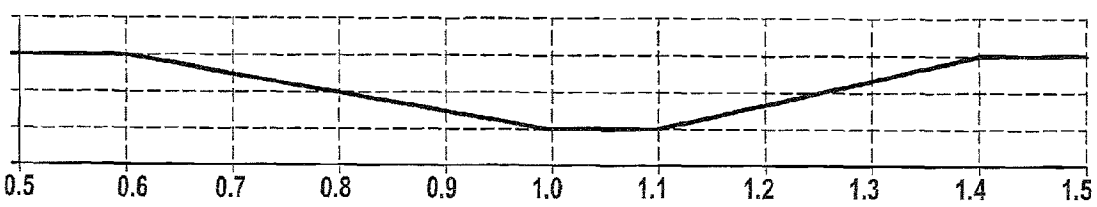
Figure 6:
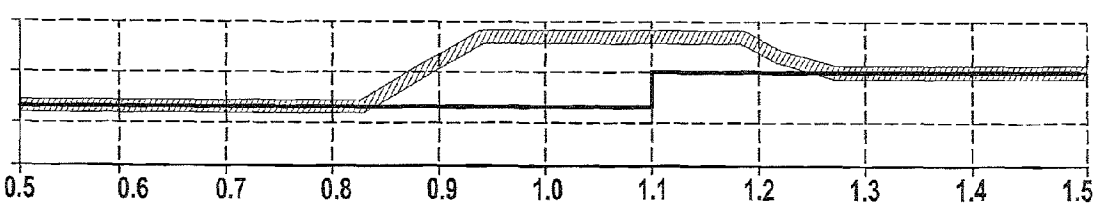
Figure 7:
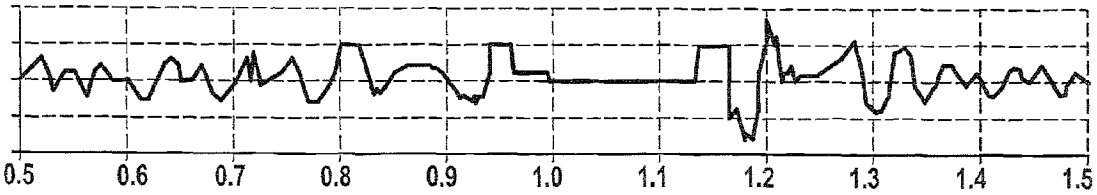

One exemplary embodiment of the invention is explained in greater detail below with reference to the drawing, in which:

FIG. 1 shows a schematic partial illustration of a reciprocating piston internal combustion engine which has a device for setting the phase angle of the camshaft relative to the crankshaft, FIG. 2 shows a camshaft adjusting device, FIG. 3 shows a graph of a state signal for adjusting the phase angle of the camshaft relative to the crankshaft, wherein the time in seconds is plotted on the abscissa and the state signal is plotted on the ordinate, FIG. 4 shows a graph of a switch-on signal for the ignition of the internal combustion engine, wherein the time in seconds is plotted on the abscissa and the switch-on signal is plotted on the ordinate, FIG. 5 shows a graph of the rotational speed curve of an internal combustion engine, wherein the time in seconds is plotted on the abscissa and the rotational speed in rev/min is plotted on the ordinate, FIG. 6 shows a graph of the actual phase angle (hatched line) and a setpoint value signal (unhatched line) for the phase angle, wherein the time in seconds is plotted on the abscissa and the phase angle in degrees is plotted on the ordinate, and FIG. 7 shows a graph of the operating current of an electric motor, wherein the time in seconds is plotted on the abscissa and the operating current in amperes is plotted on the ordinate.

An adjusting apparatus for the rotary angle position of the camshaft 3 relative to the crankshaft 5 of a reciprocating piston internal combustion engine has, according to FIG. 1, an adjusting gear mechanism 1 which is in the form of a triple-shaft gear mechanism with a drive shaft which is fixed to the crankshaft, an output shaft which is fixed to the camshaft, and an adjusting shaft. The adjusting gear mechanism can be an epicyclic gear mechanism, preferably a planetary gear mechanism.

The drive shaft is connected in a rotationally fixed manner to a camshaft gearwheel 2 which is drive-connected in a manner which is known per se to a crankshaft gearwheel, which is arranged in a rotationally fixed manner on the crankshaft 5 of the internal combustion engine, by means of a chain or a toothed belt. The output shaft is connected to the camshaft 3 in a rotationally fixed manner. The adjusting shaft is connected to the rotor of an electric motor 4 in a rotationally fixed manner. The adjusting gear mechanism 1 is integrated in the hub of the camshaft gearwheel 2.

In order to limit the rotation angle between the camshaft 3 and the crankshaft 5 of the internal combustion engine, the adjusting apparatus has a stop element 6 which is firmly connected to the drive shaft of the adjusting gear mechanism 1 and a mating stop element 7 which is connected to the camshaft 3 in a rotationally fixed manner and comes to rest against the stop element 6 in a stop position in the use position.

FIG. 1 shows that, in order to measure the crankshaft rotary angle, a magnetic detector 8 is provided which detects the tooth flanks of a crown gear 9 which is composed of a magnetically permeable material and is arranged on the crankshaft 5. One of the tooth gaps or teeth of the crown gear 9 has a larger width than the other tooth gaps or teeth and marks a reference rotary angle position of the crankshaft 5.

When the reference rotary angle position is reached, a reference marker is generated in the sensor signal of the magnetic detector 8, which is also called the crankshaft sensor signal in the text which follows. This is achieved by virtue of the crankshaft crown gear 9 having a larger gap at the reference rotary angle position than between its other teeth. As soon as the reference marker in the crankshaft sensor signal is detected, a rotary angle measurement signal is set to a, value which is associated with the reference rotary angle position. The rotary angle measurement signal is then updated each time the state of the crankshaft sensor signal changes by an interrupt being triggered in an operating program of a controller and the rotary angle measurement signal being incremented in the said interrupt.

The electric motor 4 provided is an EC motor which has a rotor whose circumference has arranged on it a row of magnet segments which are magnetized alternately in opposite directions and magnetically interact with teeth of a stator via an air gap. The teeth are wound with a winding which is supplied with power by means of an actuation device.

The position of the magnet segments relative to the stator and thus the adjusting shaft rotary angle are detected with the aid of the measuring device which has, on the stator, a plurality of magnetic field sensors 10 which are arranged offset with respect to one another in the circumferential direction of the stator in such a way that a number of magnet segment/sensor combinations is run through for every revolution of the rotor. The magnetic field sensors 10 generate a digital sensor signal which runs through a sequence of sensor signal states which, in the event of full mechanical rotation of the rotor, is repeated the same number of times as the number of magnetic field sensors 10 in the measuring device. This sensor signal is also called the adjusting shaft sensor signal in the text which follows.

When the internal combustion engine is started, a position measurement signal is set to a position measurement signal start value—independently of the position in which the rotor or the adjusting shaft is currently located. The adjusting shaft is then rotated, wherein an interrupt is triggered in the operating program of the controller each time the adjusting shaft sensor signal changes state, and the position measurement signal is updated at the said interrupt.

A Hall sensor 11, which interacts with a trigger wheel 12 which is arranged on the camshaft 3, is provided as a reference signal transmitter for the camshaft rotary angle. When a prespecified rotary angle position of the camshaft 3 is reached, a flank is generated in a camshaft reference signal. If the Hall sensor 11 detects the flank, an interrupt is triggered in an operating program of a controller and the crankshaft rotary angle and the adjusting shaft rotary angle are buffer-stored at the said interrupt for the purpose of further processing in order to adjust the phase angle. This interrupt is also called a camshaft interrupt in the text which follows. Finally, a time slot-controlled interrupt, which is called a cyclical interrupt in the text which follows, is also triggered in the operating program of the controller.

The current phase angle is calculated with the aid of the crankshaft rotary angle measurement signal, the position measurement signal and a gear mechanism characteristic variable, specifically the transmission ratio of the adjusting gear mechanism 1 between the adjusting shaft and the camshaft 3 when the drive shaft is stationary:

$$\varepsilon_{Act1}(t) = \varepsilon_{Abs} + \frac{1}{-1_g} \cdot (2 \cdot [\varphi_{Em,ICyc} - \varphi_{Em,ICam}] - [\varphi_{Cnk,ICyc} - \varphi_{Cnk,ICam}])$$

where $\phi_{Em,ICyc}=\phi_{Em}(t_{ICyc})$ is the rotary angle of the rotor of the electric motor 4 from the last detected crankshaft reference marker up to the current cyclical interrupt, $\phi_{Cnk,ICyc}=\phi_{Cnk}(t_{ICyc})$ is the rotary angle of the crankshaft 5 from the last detected crankshaft reference marker up to the current cyclical interrupt, $\phi_{Em,Icam}$ is the rotary angle of the rotor of the electric motor 4 from the last detected crankshaft reference marker up to the last camshaft interrupt, $\phi_{Cnk,ICam}$ is the rotary angle of the crankshaft 5 from the last detected crankshaft reference marker up to the last camshaft interrupt, and $\epsilon_{Abs}$ is the absolute phase angle which is determined at each camshaft interrupt by measurement and is equal to the crankshaft rotary angle $\phi_{Cnk,ICyc}$ at this time.

The phase angle signal is therefore updated starting from a reference rotary angle value when the crankshaft sensor signal and/or the adjusting shaft sensor signal change/changes state. The phase angle signal which is determined in this way is adjusted to a setpoint phase angle signal which is provided by a control device, for example a motor controller. In the exemplary embodiment shown in FIGS. 3 to 7, this adjustment takes place with a setpoint phase angle of 125° between times t=0.5 s and t=0.6 s at a crankshaft rotational speed of approximately 1000 rpm.

If the ignition of the internal combustion engine is switched off while the internal combustion engine is running and/or the rotational speed of the crankshaft is lowered to below a prespecified minimum rotational speed value, for example because the internal combustion engine has stalled, a motor stopping strategy is initiated. In the exemplary embodiment according to FIGS. 3 to 7, the ignition is switched off at time t=0.6 s. FIG. 5 clearly shows that the rotational speed of the crankshaft 5 drops down to the value zero in an approximately ramp-like manner starting from this time. Adjustment of the phase angle signal is initially continued for as long as the control device generates the setpoint phase angle signal and the rotational speed of the crankshaft 5 exceeds a prespecified limit value.

As soon as the reference rotary angle position of the crankshaft 5 and/or the flank in the camshaft reference signal can no longer be detected or can be detected only unreliably on account of severe oscillations when the prespecified limit value is undershot, the phase angle is determined with respect to the last reliably detected reference rotary angle position:

$$\varepsilon_{Act1}(t) = \varepsilon_{Ref} + \frac{1}{-1_g} \cdot (2 \cdot [\varphi_{Em}(t) - \varphi_{Em,Ref}] - [\varphi_{Cnk}(t) - \varphi_{Cnk,Ref}])$$

where $\epsilon_{Ref}$ is the absolute phase angle at the last camshaft interrupt at which the reference rotary angle position was reliably detected, $\phi_{Em,Ref}=\phi_{Em}(t_{Ref})$ is the rotary angle of the rotor of the electric motor 4 at the last camshaft interrupt at which the reference rotary angle position was reliably detected, $\phi_{Cnk,Ref}=\phi_{Cnk}(t_{Ref})$ is the rotary angle of the crankshaft 5 at the last camshaft interrupt at which the reference rotary angle position was reliably detected, $\phi_{Em}(t)$ is the rotary angle of the rotor of the electric motor 4 since the last camshaft interrupt at which the reference rotary angle position was reliably detected, and $\phi_{Cnk}(t)$ is the rotary angle of the crankshaft 5 since the last camshaft interrupt at which the reference rotary angle position was reliably detected.

Adjustment of the phase angle signal is terminated at time t=0.8 s. The electric motor 4 is then—while the crankshaft 5 and/or the camshaft 3 are/is still rotating—supplied with power in such a way that the stop element 6 is moved towards the mating stop element 7 and comes to rest against the said mating stop element. In the exemplary embodiment according to FIGS. 3 to 7, travel up to a stop begins at time t=0.8 s. FIG. 6 shows that the phase angle between t=0.8 s and t=0.94 s rises in an approximately ramp-like manner at a speed of approximately 250° crankshaft/s until the stop position is reached at a phase angle of 154°. This is achieved by the rate of change in the phase angle signal (phase speed) being adjusted to the value of 250° crankshaft/s during travel up to a stop. However, it is also possible to actuate the electric motor 4 by pulse-width modulation with a prespecified mark-to-space ratio during travel up to a stop. The phase angle value of the camshaft 3 at the stop position relative to the crankshaft 5 is known and stored, for example in the control device. This phase angle is also called the reference position in the text which follows.

The reference position is reached at t=0.94 s. The reference position is detected at t=0.9655 s on the basis of the reduction in phase speed which occurs at the reference position, following which the power supply to the electric motor 4 is changed over to a retaining power supply. This has the effect of pressing the stop element against the mating stop element. FIG. 7 shows that the retaining power supply begins at t=0.9655 s and ends at t=1 s when the crankshaft rotational speed reaches the value zero. The supply of power to the electric motor 4 is terminated at t=1 s in order to protect the said electric motor against overloads.

In the exemplary embodiment shown in FIGS. 3 to 7, the adjustment was continued for approximately 200 ms after the ignition was switched off. The concluded travel to a stop during stopping of the motor enables early adjustment of the phase angle relative to the reference position for the subsequent starting operation of the internal combustion engine. As shown in FIG. 5, the internal combustion engine is restarted at t=1.12 S. The crankshaft rotational speed then increases in a ramp-like manner to a value of 1000 rpm which corresponds to the idling rotational speed of the internal combustion engine.

Between t=1.14 s and t=1.16 s, the electric motor 4 is supplied with power in such a way that the stop element 6 is positioned against the mating stop element 7. The reference position is detected and the phase angle signal is set to the reference value at approximately t=1.16 s, that is to say as early as 40 ms after the motor is started. The phase angle signal is then adjusted to the setpoint phase angle signal. Starting from time t=1.4 s, the phase angle is adjusted with respect to the reference rotary angle position.

In the method for setting the rotary angle position of the camshaft 3 of a reciprocating piston internal combustion engine relative to the crankshaft 5, the crankshaft is therefore connected to the camshaft 3 by means of a triple-shaft gear mechanism. The said triple-shaft gear mechanism has a drive shaft which is fixed to the crankshaft, an output shaft which is fixed to the camshaft, and an adjusting shaft which is driven by an electric motor 4. A crankshaft sensor signal is detected which changes its state when the rotary angle of the crankshaft 5 changes. Furthermore, an adjusting shaft sensor signal is detected which changes its state when the rotary position of the adjusting shaft changes. Starting from a reference rotary angle value, a phase angle signal is updated and adjusted to a provided setpoint phase angle signal when the crankshaft sensor signal and/or the adjusting shaft sensor signal change/changes state. The ignition of the internal combustion engine is then switched off and/or the rotational speed of the crankshaft 5 is lowered to below a prespecified minimum rotational speed value. While the crankshaft 5 and/or the camshaft 3 are still rotating, the electric motor 4 is supplied with power in such a way that the camshaft 3 rotates in the direction of a prespecified reference position relative to the crankshaft 5. When the internal combustion engine is next started, the camshaft 3 and crankshaft 5 are positioned in accordance with the reference position and this is detected with the aid of a sensor. The phase angle signal is set to a reference value and then adjusted to the setpoint phase angle signal.

LIST OF REFERENCE SYMBOLS

1 Adjusting gear mechanism
2 Camshaft gearwheel
3 Camshaft
4 Electric motor
5 Crankshaft
6 Stop element
7 Mating stop element
8 Magnetic detector
9 Crown gear
10 Magnetic field sensor
11 Hall sensor
12 Trigger wheel

The invention claimed is:

1. A method for setting the rotary angle position of the camshaft of a reciprocating piston internal combustion engine relative to the crankshaft, wherein the crankshaft is drive-connected to the camshaft by means of an adjusting gear mechanism which is in the form of a triple-shaft gear mechanism with a drive shaft which is fixed to the crankshaft, an output shaft which is fixed to the camshaft, and an adjusting shaft which is drive-connected to an electric motor, wherein the crankshaft rotates and a crankshaft sensor signal is detected which changes its state when the rotary angle of the crankshaft changes, wherein the adjusting shaft rotates and an adjusting shaft sensor signal is detected which changes its state when the rotary position of the adjusting shaft changes, wherein a phase angle signal is updated, starting from a reference rotary angle value which is associated with a reference rotary angle position, when the state of the crankshaft sensor signal and/or of the adjusting shaft sensor signal changes, wherein the phase angle signal is adjusted to a provided setpoint phase angle signal, and wherein the ignition of the internal combustion engine is switched off and/or the rotational speed of the crankshaft is lowered to below a prespecified minimum rotational speed value, wherein, when the ignition is switched off and/or after the rotational speed of the crankshaft falls below the prespecified minimum rotational speed value of the crankshaft, the electric motor is supplied with power—while the crankshaft and/or the camshaft are still rotating—in a way that the camshaft rotates in the direction of a prespecified reference position relative to the crankshaft.

2. The method according to claim 1, wherein the power supply to the electric motor is changed to a retaining power supply in order to maintain the reference position when the reference position is detected when the ignition is switched off and/or after the rotational speed falls below the minimum rotational speed value.

3. The method according to claim 1 wherein the retaining power supply is terminated when the crankshaft and the camshaft come to a stop or the crankshaft reaches the minimum rotational speed value again.

4. The method according to claim 1 wherein a stop element is connected to the drive shaft and a mating stop element is connected to the camshaft, in that the stop element comes to rest against the mating stop element at the reference position, and in that the rate of change in the phase angle signal is measured and the fact that the reference position is reached is detected on the basis of an absolute reduction in the rate of change.

5. The method according to claim 1 wherein, during retaining power supply, a torque is applied to the adjusting shaft with the aid of the electric motor, which torque positions the stop element against the mating stop element.

6. The method according to claim 1 wherein the phase angle signal continues to be adjusted after the ignition is switched off and/or after the rotational speed falls below the minimum rotational speed value for as long as the control device generates the setpoint phase angle signal and the rotational speed of the crankshaft exceeds a prespecified limit value, and in that the camshaft is then rotated in the direction of the reference position relative to the crankshaft with the aid of the electric motor.

7. The method according to claim 1 wherein a reference marker is generated in the crankshaft sensor signal when a prespecified reference rotary angle position of the crankshaft is reached before the ignition is switched off and/or before the rotational speed of the crankshaft is lowered to below the minimum rotational speed value, in that a rotary angle measurement signal is set to a value which is associated with the reference rotary angle position when the reference marker occurs, in that the rotary angle measurement signal is updated when the crankshaft sensor signal changes state, in that a position measurement signal is set to a position measurement signal start value, in that the position measurement signal is updated each time the adjusting shaft sensor signal changes state, in that a camshaft reference signal is generated when a prespecified rotary angle position of the camshaft is reached, in that the measurement values, which are respectively present when the camshaft reference signal occurs, of the rotary angle measurement signal and of the position measurement signal are determined and these measurement values and the gear mechanism characteristic variable are used to determine a value for the phase angle signal.

* * * * *